US008303425B2

(12) United States Patent
Bonfiglioli

(10) Patent No.: US 8,303,425 B2
(45) Date of Patent: Nov. 6, 2012

(54) EQUIPMENT FOR A FUNFAIR

(75) Inventor: Giancarlo Bonfiglioli, Castello D'Argile (IT)

(73) Assignee: ACHA S.R.L., Bologna (IT)

( * ) Notice: Subject to any disclaimer, the term of this patent is extended or adjusted under 35 U.S.C. 154(b) by 700 days.

(21) Appl. No.: 12/062,974

(22) Filed: Apr. 4, 2008

(65) Prior Publication Data

US 2009/0253524 A1 Oct. 8, 2009

(51) Int. Cl.
*A63G 31/00* (2006.01)

(52) U.S. Cl. ..... 472/30

(58) Field of Classification Search ..... 472/30
See application file for complete search history.

(56) References Cited

U.S. PATENT DOCUMENTS

| | | | | |
|---|---|---|---|---|
| 2,328,852 | A * | 9/1943 | Shepherd | 472/30 |
| 3,840,225 | A * | 10/1974 | Fouche | 472/3 |
| 5,509,631 | A * | 4/1996 | De Salvo | 248/370 |
| 5,558,581 | A * | 9/1996 | Knijpstra | 472/31 |
| 2008/0064514 | A1 * | 3/2008 | Larsen | 472/94 |

* cited by examiner

*Primary Examiner* — Michael Dennis
(74) *Attorney, Agent, or Firm* — Browdy and Neimark, PLLC

(57) ABSTRACT

Equipment (1) for a funfair includes: a rigid body (5) provided with at least a place (51) for a passenger; a frame (10) for supporting the body (50), through a supporting mechanism (14, 17, 52) which enables the body (50) to rotate with respect to a first rotation axis (X) and a second rotation axis (Y) located perpendicular to one another and being solidly mobile in rotation with respect to a fixed third rotation axis (Z); and a mechanism (16, 18, 22) for rotating the body (50) with respect to the first rotation axis (X), the second rotation axis (Y) and the third rotation axis (Z), independently of one another.

8 Claims, 5 Drawing Sheets

EQUIPMENT FOR A FUNFAIR

The invention relates to equipment for a funfair.

More in particular, the invention relates to an equipment for a funfair which houses a plurality of passengers, solidly anchored internally of a moving environment.

BACKGROUND

As is known, this type of equipment allows passengers to follow unordered and unpredictable trajectories in space.

The passengers' enjoyment consists in being subjected to centrifugal forces and accelerations which vary continuously in direction and sort.

SUMMARY

The aim of the invention is to make available an equipment for funfairs which realises the above unordered movements with rotations about various axes in order to perform movements on a continuous trajectory which varies irregularly and at random, and all with a simple and rational construction solution.

The aim is attained by an equipment for funfairs in which the structure housing the passengers is made to rotate with respect to a pair of rotation axes located perpendicular to one another and reciprocally mobile in rotation with respect to a fixed third axis.

Further characteristics and advantages of the invention will emerge from a reading of the following description, provided by way of non-limiting example, with the aid of the figures of the appended drawings, in which:

DETAILED DESCRIPTION OF THE INVENTION

Figure 1:
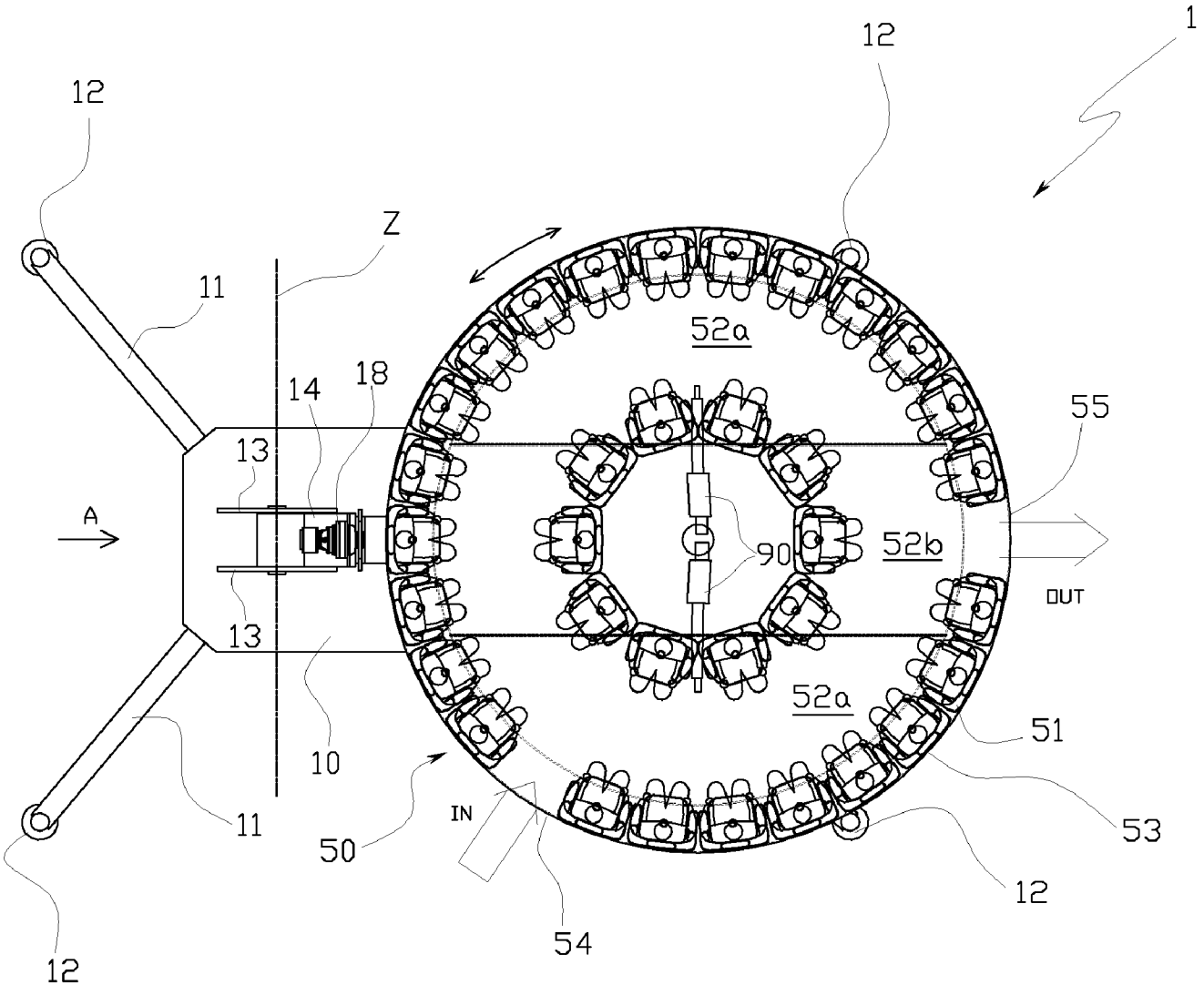
FIG. 1 is a view from above of the equipment for funfairs according to the present invention.
Figure 2:
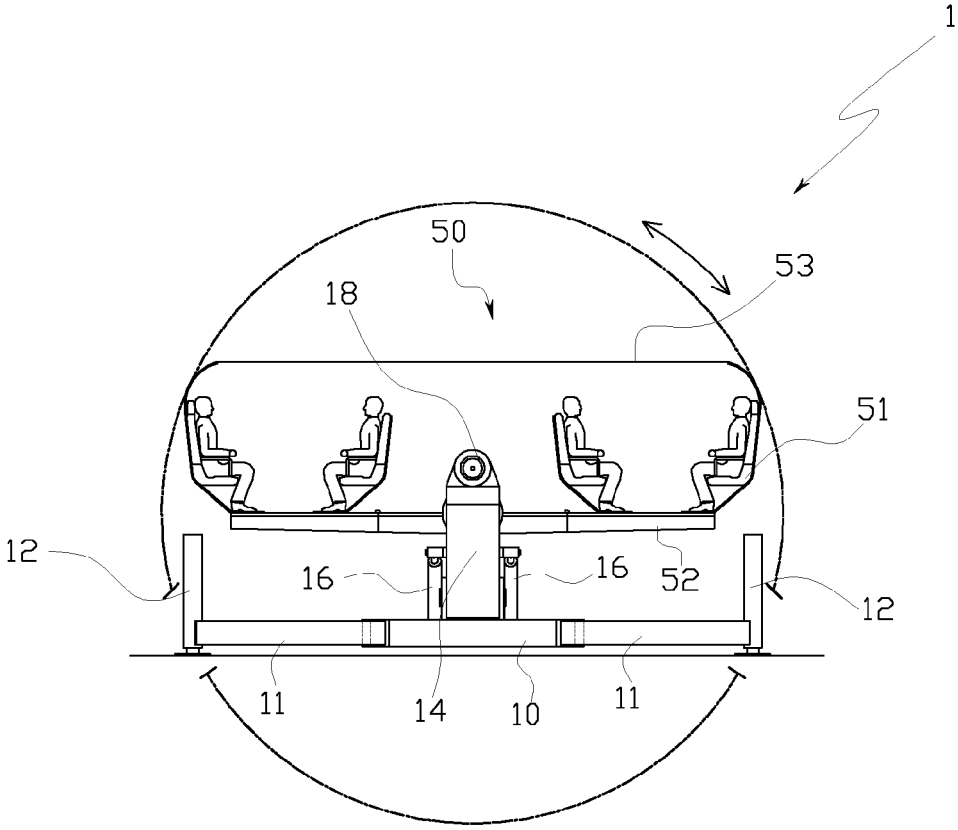
FIG. 2 is a view in direction A of FIG. 1, showing the inside of the body.

With reference to the figures of the drawings, 1 denotes in its entirety the equipment for funfairs of the present invention.

The equipment 1 comprises, in a general description, a rigid body 50 provided with places 51 for passengers and associated to a support frame by special means of supporting, of which a fuller description will be given herein below.

In the present invention, the body 50 is made to rotate about three rotation axes, denoted by X, Y and Z, of which the first two X and Y are perpendicular to one another and are solidly mobile with respect to the third axis Z, which is fixed.

The invention will now be described in greater detail.

The frame is constituted by a flat platform 10 provided with four retractable legs 11 located at the four corners, at the end of each of which legs 11 a foot 12 is fixed for resting on the ground, which foot 12 is vertically commanded by a jack.

Two parallel tabs 13 rise from the platform 11, on which tabs 13 a support element 14 is rotatably mounted with respect to the horizontally lying fixed axis Z.

Figure 3:
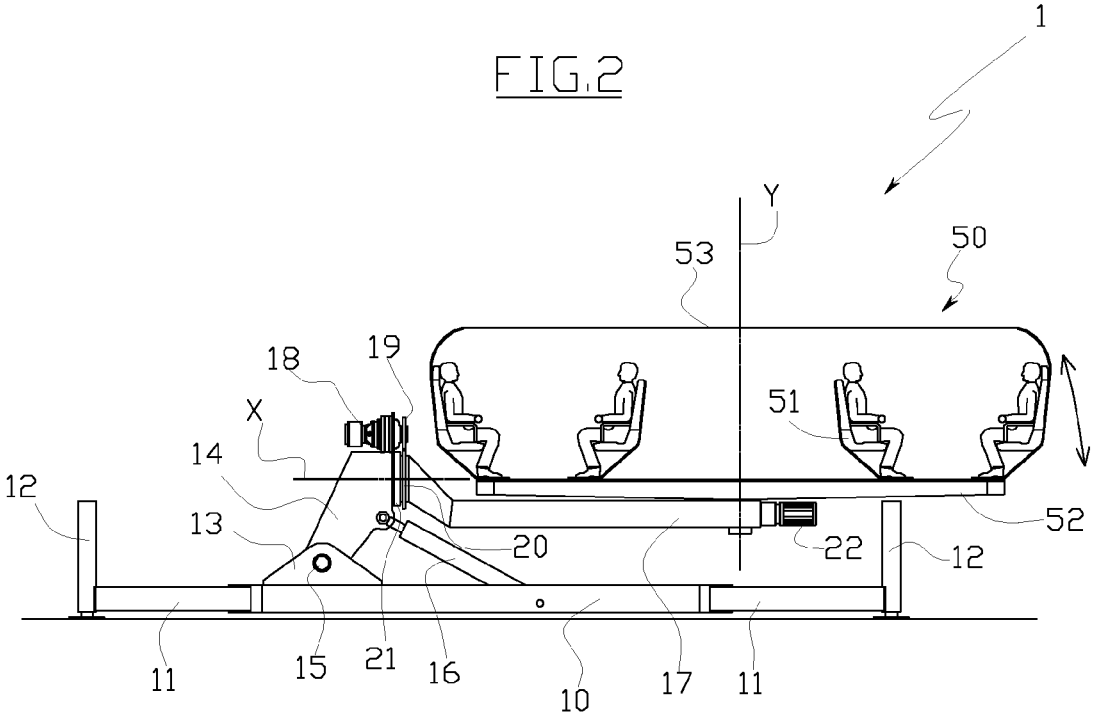
FIGS. 3, 4 and 5 are a lateral view of the equipment with the inside of the body in view.
Figure 4:
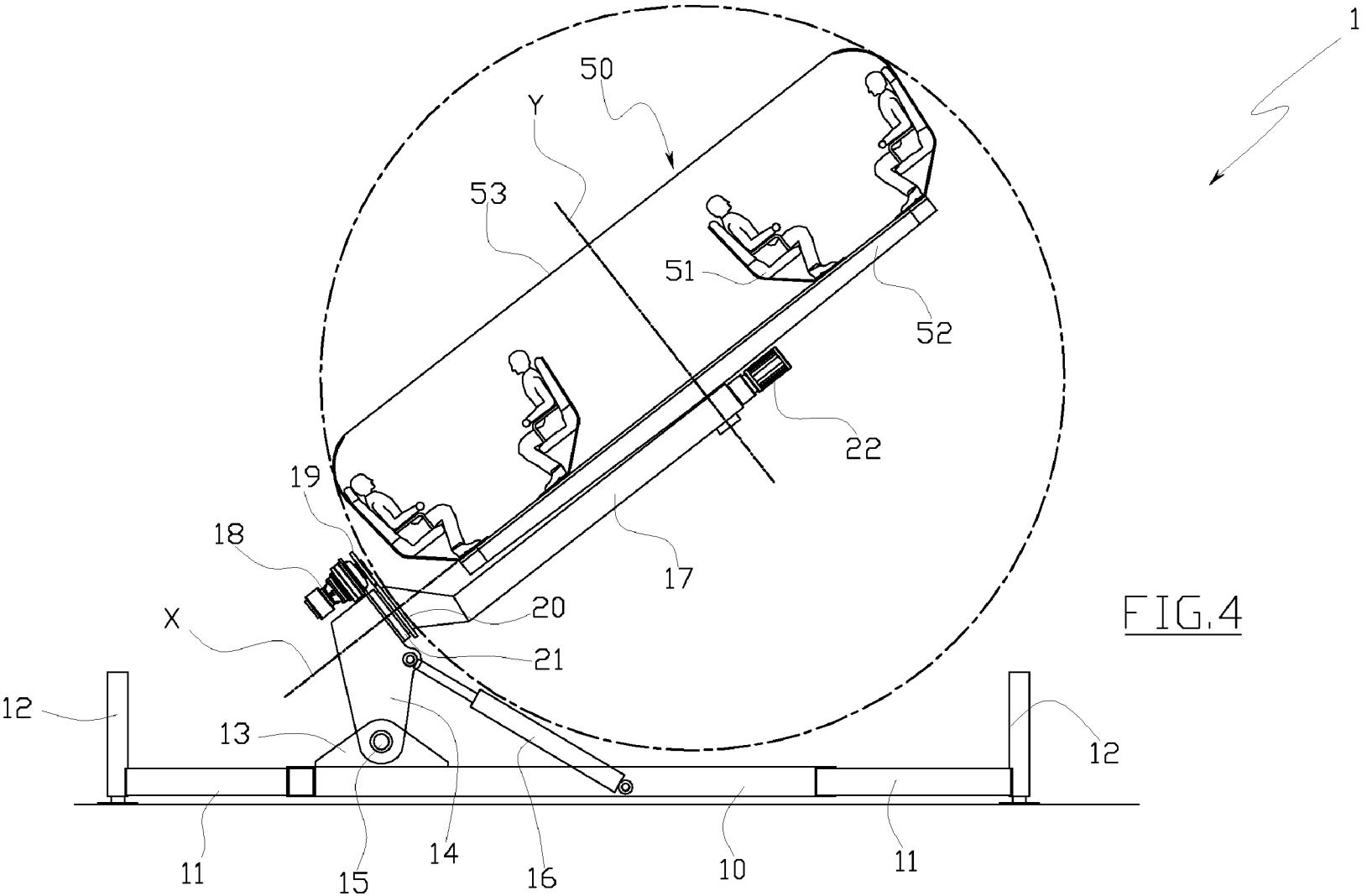
Figure 5:
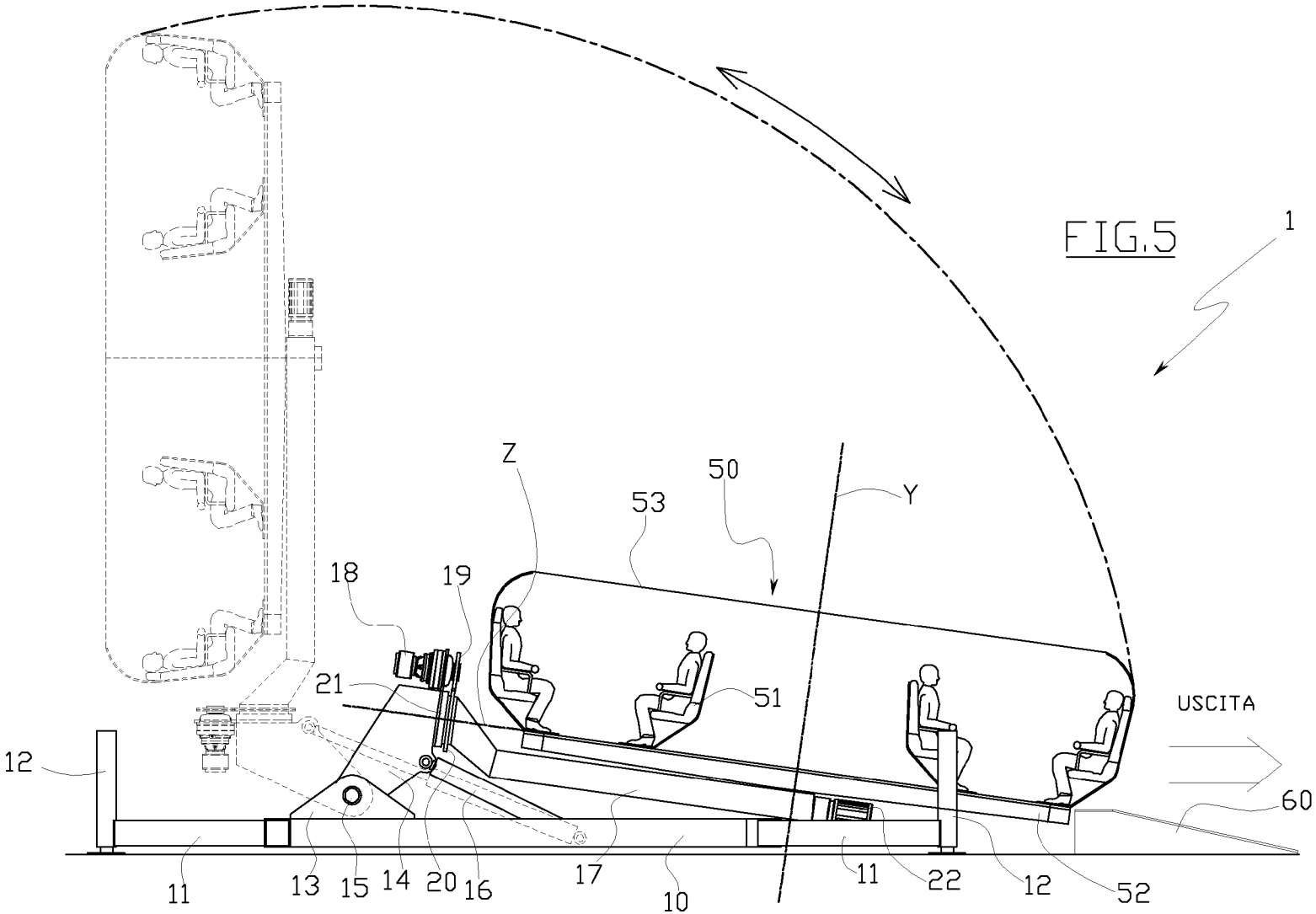
Figure 6:
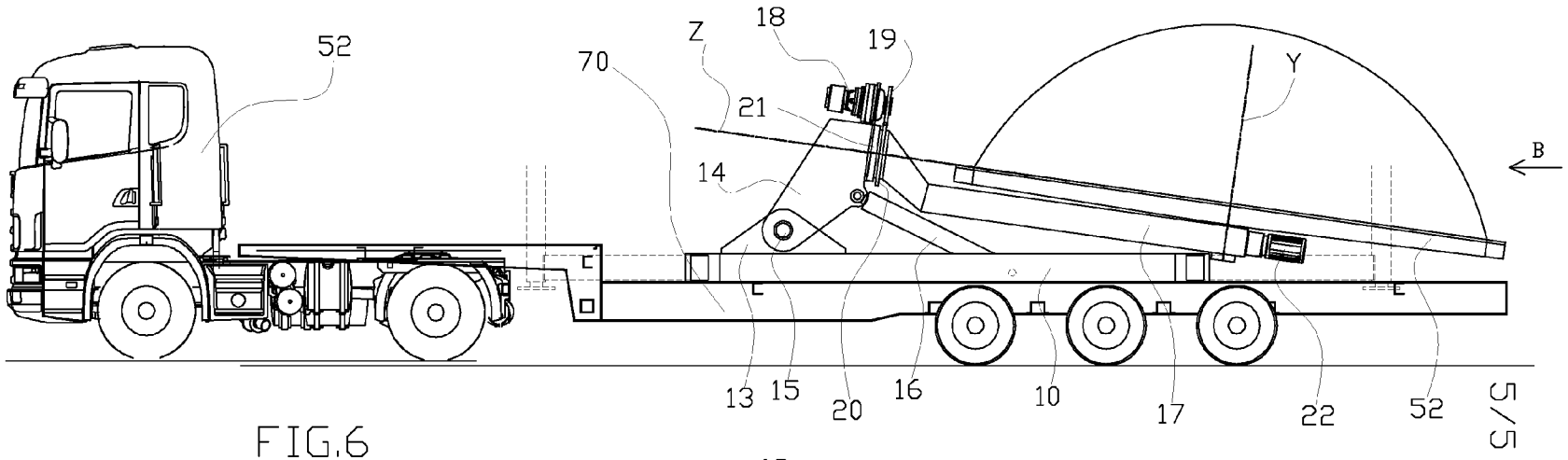
FIG. 6 is a lateral view of the equipment during transport thereof.

In particular, an end of the support element 14 is hinged to the tabs 13 by means of a rotation pivot 15 located horizontally and coaxially to the axis Z (FIGS. 3-5).

The rotation of the support element 14 is guaranteed by two identical cylinder-piston groups 16 pivoted at an end thereof to the platform 10 and at the other end thereof to the support element 14.

By activating the cylinder-piston groups 16, the support element 14 can oscillate about the pivot 15.

Naturally the arc of oscillation which the support element 14 can describe is comprised between two points corresponding to the minimum and maximum lengths that the cylinder-piston groups 16 can attain, which in the illustrated embodiment is about 90°.

At the opposite end of the support element 14 to the pivoted end thereof, a rotating arm 17 is fixed, with a fifth wheel 21 interposed which can rotate with respect to the axis X.

In the illustrated embodiment, the rotation of the arm 17 is performed by a motor 18 fixed on the support element 14 and also fixed to the shaft on which a pinion 19 is keyed, which pinion 19 enmeshes with a cogwheel 20 fashioned on the arm 17.

The arm 17 extends parallel to the rotation axis X forming an elbow in proximity of the fifth wheel 21.

In substance, by rotating the pinion 19, the arm 17 rotates about the axis X with respect to the support element 14 which remains still due to the presence of the fifth wheel 21.

A circular flat base 52 is fixed to the free end of the arm 17, with a further fifth wheel interposed, perimetrally of which base 52 a wall 53 is fixed in order to form the body 50 for the passengers.

In particular the base 52 lies on a parallel plane to the rotation axis X of the arm 17 and is destined to rotate about the axis Y, perpendicular to the axis X and thus perpendicular to the base 52.

In the illustrated embodiment, the base 52 is set in rotation by means of a pair of conical wheels, not visible in the figures, which are respectively keyed on the shaft of a motor 22 and on a shaft centrally departing from the base 52, and is fixed to the rotating element of the fifth wheel.

In the illustrated embodiment, the motor 22 is fixed to the free end of the arm 17.

In substance, by activating the motor 22, the base 52 and therefore the body 50 formed together with the base 52 rotate about the axis Y with respect to the arm 17 which remains still due to the presence of the fifth wheel 22.

In particular, the rotations of the shafts of the motors 18 and 22 are controlled by a respective encoder, not illustrated, and are commanded, according to a determined program, by an electronic control system, which also manages the activation of the cylinder-piston group 16.

Alternatively, the random activation of the motors 18 and 22 and/or the cylinder-piston group 16 can be manually performed.

In the illustrated embodiment, the places 51, provided with belts for constraining the passenger in his or her place 51, are located side-by-side in two circular rows having the respective seats facing one another, as in FIG. 1.

Naturally, any other arrangement of the places can be realised.

To afford the passengers access to the places 51 and to leave the body 50 at the end of the cycle, two openings are afforded on the perimeter wall 53, respectively an entrance and exit, denoted by 54 for the entrance and 55 for the exit (FIG. 1).

Operatively, before the cycle begins, the body 50 is located in a position (see FIG. 3) in which the passengers can enter the body 50 through the entrance opening 53, for example by means of a removable set of steps.

Once the passengers have reached the places 51 and buckled the belts, the body 50 is made to rotate about the axes X, Y and Z, by activating the two motors 16 and 18 and the cylinder-piston group 16 independently of one another.

The base 52, and therefore the body 50, rotate with respect to all three axes X, Y and Z, the arm 17 rotates with respect to the axes X and Z, the support element rotates only with respect to the axis Z.

The rotations are managed by the electronic control system, in order to enable the body 50 to perform random rotations about the two perpendicular axes X and Y and about the fixed axis Z.

Naturally the rotations about the axes X and Y can be complete 360° rotations, while those about the axis Z are limited to an arc of circumference, as previously mentioned of about 90° in the illustrated embodiment.

Further, the rotation direction about the axes X, Y and Z can be varied during the cycle.

At the end of the cycle, the passengers reach the exit opening 55, which is conveniently brought in proximity of a descent ramp 60 in order to facilitate an easier exit, as shown in FIG. 5.

With the aim of enabling easier transport of the entire equipment 1 on a trailer 70 drawn by a truck 80, the wall 53 and the places 51 are removed.

Further, in order to reduce the dimensions, the base 52 is made in such a way as to be foldable.

Figure 7:
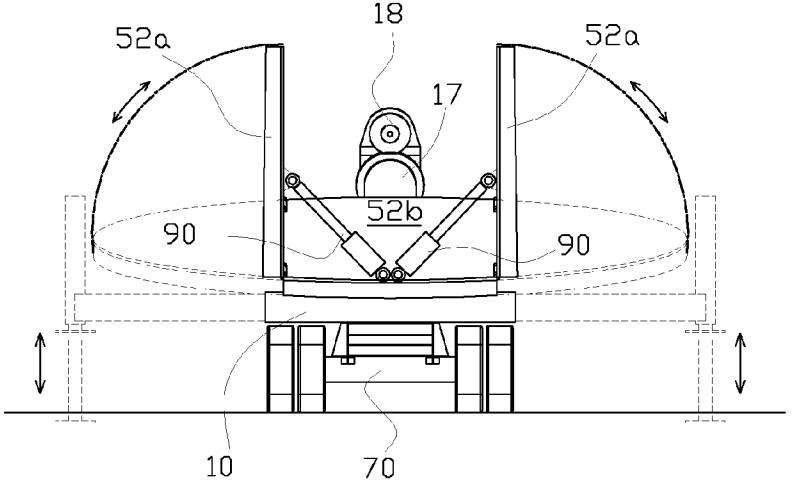
FIG. 7 is a view in direction B of FIG. 6.

In the illustrated embodiment, the base 52 is formed by two portions of lateral circle 52*a* which are equal and opposite one another, and which are hinged together at a central portion 52*b*, in order to be foldable towards the central portion 52*b*, as can be seen in FIG. 7.

With the aim of facilitating the operation, a pair of jacks 90 are used, which jacks 90 are fixed at an end thereof to the central portion 52*b* and at the other end thereof to the respective lateral portion 52*a*.

As can be appreciated from the foregoing description, the equipment for funfairs of the present invention is able to satisfy the needs and obviate the drawbacks mentioned in the introductory part of the present description with reference to the prior art.

Indeed, the equipment for funfairs of the present invention enables a multiplicity of random movements due to the rotation of the body about the three axes X, Y and Z, with an extremely compact structure, which is safe and easy to realise.

Obviously, an expert in the sector, with the aim of satisfying contingent needs and specifications, could bring numerous modifications and variations to the above-described equipment for funfairs, without its forsaking the sought ambit of protection of the invention, as defined in the following claims.

The invention claimed is:

1. Equipment (1) for a funfair, comprising:

a rigid body (50) provided with places (51) for passengers;

a frame (10) that supports the body (50) through means (14, 17, 52) for supporting the body (50) which enable the body (50) to rotate with respect to a first rotation axis (X) and a second rotation axis (Y) located perpendicular to one another and being solidly mobile in rotation with respect to a horizontal third rotation axis (Z) fixed on the frame (10), and means (16, 18, 22) for rotating the body (50) with respect to the first rotation axis (X), the second rotation axis (Y), and the third rotation axis (Z) independently with respect to one another, wherein the means for supporting the body (50) comprise an arm (17) rotatable with respect to the first rotation axis (X) and a flat base (52) rotatable about the second rotation axis (Y) that extends perpendicular to the base (52), the base (52) being fixed to a free end of the aim (17), the body (50) being formed by the base (52) and by a removable perimeter wall (53) enclosing the places (51);

wherein the base (52) exhibits a circular conformation and is formed by two lateral circular portions (52*a*) which are equal and opposite one another and which are hinged to a central portion (52*b*), the lateral portions (52*a*) being foldable towards the central portion (52*b*); and wherein the lateral portions (52*a*) are raised by means of a pair of jacks (90) fixed at an end to the central portion (52*b*) and at another end to the respective lateral portion (52*a*).

2. Equipment (1) for a funfair, comprising: a stationary horizontal frame (10); a support element (14) rotatably mounted on a horizontally lying axis Z stationary with respect to the stationary frame; at least one cylinder-piston unit (16) pivoted at an end thereof to the horizontal frame (10) and at another end thereof to the support element (14); an arm (17) rotatably supported by the support element, on an axis X orthogonal to the axis Z; means to rotate the arm (17) on the axis X; and a flat base (52) rotatably supported at a free end of the arm (17) which rotates about a rotation axis (Y) that extends perpendicular to the base (52) and to the stationary axis Z, places (51) being provided on the flat base (52); wherein the arm (17) is set in rotation about the first rotation axis (X) by a pinion/cogwheel system (19, 20), the pinion (19) being keyed on a shaft of a first motor (18) and the cogwheel (20) being fashioned circumferentially on the arm (17).

3. The equipment (1) of claim 2, wherein the first motor (18) is fixed on the support element (14) in proximity of a second end thereof.

4. The equipment (1) of claim 2, wherein the base (52) is set in rotation about the second rotation axis (Y) by a second motor (22).

5. The equipment (1) of claim 4, wherein the second motor (22) is fixed on the arm (17) in proximity of the free end thereof.

6. The equipment (1) of claim 2, wherein the base (52) exhibits a circular conformation and is formed by two lateral circular portions (52*a*) which are equal and opposite one another and which are hinged to a central portion (52*b*), the lateral portions (52*a*) being foldable towards the central portion (52*b*).

7. The equipment (1) of claim 2, comprising an electronic control system which independently commands the rotations of the base 52 with respect to the first rotation axis (X), the second rotation axis (Y) and the third rotation axis (Z) according to a random program.

8. The equipment (1) of claim 2, wherein the first rotation axis (X), the second rotation axis (Y), and the third rotation axis (Z) are mutually perpendicular with respect to each other.

* * * * *